US010875552B2

(12) United States Patent
Taga et al.

(10) Patent No.: US 10,875,552 B2
(45) Date of Patent: Dec. 29, 2020

(54) RAILCAR BOGIE

(71) Applicant: KAWASAKI JUKOGYO KABUSHIKI KAISHA, Kobe (JP)

(72) Inventors: Yukitaka Taga, Kobe (JP); Fumikazu Kounoike, Kakogawa (JP); Yukihiro Sano, Kobe (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 269 days.

(21) Appl. No.: 16/065,852

(22) PCT Filed: Nov. 29, 2016

(86) PCT No.: PCT/JP2016/005002
§ 371 (c)(1),
(2) Date: Jun. 25, 2018

(87) PCT Pub. No.: WO2017/110042
PCT Pub. Date: Jun. 29, 2017

(65) Prior Publication Data

US 2019/0009801 A1 Jan. 10, 2019

(30) Foreign Application Priority Data

Dec. 25, 2015 (JP) ..... 2015-252985

(51) Int. Cl.
*B61F 19/02* (2006.01)
*B61F 5/30* (2006.01)
*B61F 5/52* (2006.01)

(52) U.S. Cl.
CPC ..... *B61F 19/02* (2013.01); *B61F 5/30* (2013.01); *B61F 5/526* (2013.01)

(58) Field of Classification Search
CPC ..... B61F 19/00; B61F 19/02; B61F 19/08; B61F 5/30; B61F 5/526; B61F 5/52; E01H 1/00
See application file for complete search history.

(56) References Cited

U.S. PATENT DOCUMENTS 1,134,178 A * 4/1915 Blennerhassett ..... B61F 19/02 293/58
1,742,148 A * 12/1929 Ritenour ..... B61F 19/02 293/58

(Continued)

FOREIGN PATENT DOCUMENTS

CN 204488814 U 7/2015
GB 2537299 A 10/2016

(Continued)

*Primary Examiner* — Jason C Smith
(74) *Attorney, Agent, or Firm* — Oliff PLC

(57) ABSTRACT

A railcar bogie includes a wheelset, a bearing rotatably supporting the wheelset, an axle box, and an obstacle deflector. The wheelset includes: an axle and a pair of wheels provided at both car width direction sides of the axle. The axle box includes: an upper axle box element covering the bearing from above; and a lower axle box element fixed to the upper axle box element and covering the bearing from below. The obstacle deflector includes an obstacle deflecting portion and a coupling portion. The obstacle deflecting portion is arranged at one side of the wheel in a car longitudinal direction and, when viewed from the one side in the car longitudinal direction, overlaps the wheel. The coupling portion couples the obstacle deflecting portion to the axle box. The coupling portion of the obstacle deflector is fixed to a receiving seat provided at the upper axle box element.

5 Claims, 4 Drawing Sheets

(56) References Cited

U.S. PATENT DOCUMENTS

| | | | | | |
|---|---|---|---|---|---|
| 4,487,133 | A * | 12/1984 | Eggert, Jr. | B61F 5/305 | 105/224.1 |
| 5,462,324 | A * | 10/1995 | Bowen | B60R 21/34 | 293/15 |
| 6,305,297 | B1 * | 10/2001 | Landrot | B61F 5/302 | 105/157.1 |
| 8,602,466 | B2 * | 12/2013 | Barron | B60R 19/54 | 293/58 |
| D749,984 | S * | 2/2016 | Nishimura | D12/42 | |
| 9,688,292 | B2 * | 6/2017 | Nishimura | B61F 3/04 | |
| 10,118,585 | B2 * | 11/2018 | Barron | B60R 21/34 | |
| 10,362,857 | B2 * | 7/2019 | Ohata | B61F 19/08 | |
| 2010/0258026 | A1 * | 10/2010 | Kanemori | E01H 8/04 | 104/279 |
| 2012/0279416 | A1 * | 11/2012 | Nishimura | B61F 5/302 | 105/218.1 |
| 2014/0144347 | A1 * | 5/2014 | Nishimura | B61F 5/50 | 105/197.05 |
| 2018/0170410 | A1 * | 6/2018 | Wang | B61F 5/26 | |
| 2019/0016354 | A1 * | 1/2019 | Nishimura | B61F 5/302 | |
| 2019/0084596 | A1 * | 3/2019 | Taga | B61F 15/06 | |

FOREIGN PATENT DOCUMENTS

| | | | |
|---|---|---|---|
| JP | H10-278791 | A | 10/1998 |
| JP | 2014-012530 | A | 1/2014 |
| KR | 2011-0064805 | A | 6/2011 |
| WO | 2013-008469 | A1 | 1/2013 |

* cited by examiner

RAILCAR BOGIE

TECHNICAL FIELD

The present invention relates to a railcar bogie, and particularly to a railcar bogie including an obstacle deflector.

BACKGROUND ART

A railcar bogie is provided with an axle box accommodating a bearing rotatably supporting a wheelset. In some cases, the axle box is divided into upper and lower parts, i.e., is constituted by an upper axle box and a lower axle box which are fastened to each other by bolts (see PTL 1, for example).

Further, in some cases, an obstacle deflector configured to eliminate obstacles on rails is attached to the railcar bogie (see PTL 2, for example). For example, in the railcar bogie of PTL 2, a bar extending in a car longitudinal direction is fixed to the lower axle box of the axle box, and the obstacle deflector is attached to a tip end portion of the bar.

CITATION LIST

Patent Literature

PTL 1: Japanese Laid-Open Patent Application Publication No. 10-278791

PTL 2: Japanese Laid-Open Patent Application Publication No. 2014-12530

SUMMARY OF INVENTION

Technical Problem

In conventional railcar bogies, the obstacle deflector is attached to the lower axle box. Therefore, when the axle box receives vibrations by traveling, force generated by the weight of the obstacle deflector is applied to the lower axle box and the bolts. On this account, it is necessary to increase the number of bolts used and increase the strengths of the lower axle box and the bolts.

An object of the present invention is to, in a railcar bogie to which an obstacle deflector is attached, relax a requirement of strength of an attaching portion of the obstacle deflector while reducing influence of vibrations on the attaching portion.

Solution to Problem

A railcar bogie according to one aspect of the present invention includes: a wheelset including an axle extending in a car width direction and a pair of wheels provided at both respective car width direction sides of the axle; a bearing rotatably supporting the wheelset; an axle box including an upper axle box element covering the bearing from above and a lower axle box element fixed to the upper axle box element by a fastening member and covering the bearing from below; and an obstacle deflector including an obstacle deflecting portion arranged at one side of the wheel in a car longitudinal direction and, when viewed from the one side in the car longitudinal direction, overlapping the wheel and a coupling portion coupling the obstacle deflecting portion to the axle box, the coupling portion of the obstacle deflector being fixed to a receiving seat provided at the upper axle box element.

According to the above configuration, in the railcar bogie, force generated by the weight of the obstacle deflector when the axle box receives vibrations is not transferred to the lower axle box element and the fastening member. Therefore, regarding the attaching portion of the obstacle deflector, it is unnecessary to consider influence of vibrations on the lower axle box element. On this account, it is also unnecessary to, for example, increase the number of fastening members used when attaching the obstacle deflector to the bogie. Thus, both the reduction of the influence of the vibrations of the obstacle deflector and the relaxing of the requirement of the attaching strength of the obstacle deflector can be realized.

Advantageous Effects of Invention

According to the present invention, in the railcar bogie to which the obstacle deflector is attached, the requirement of the strength of the attaching portion of the obstacle deflector can be relaxed while reducing the influence of the vibrations on the attaching portion.

DESCRIPTION OF EMBODIMENTS

Figure 1:
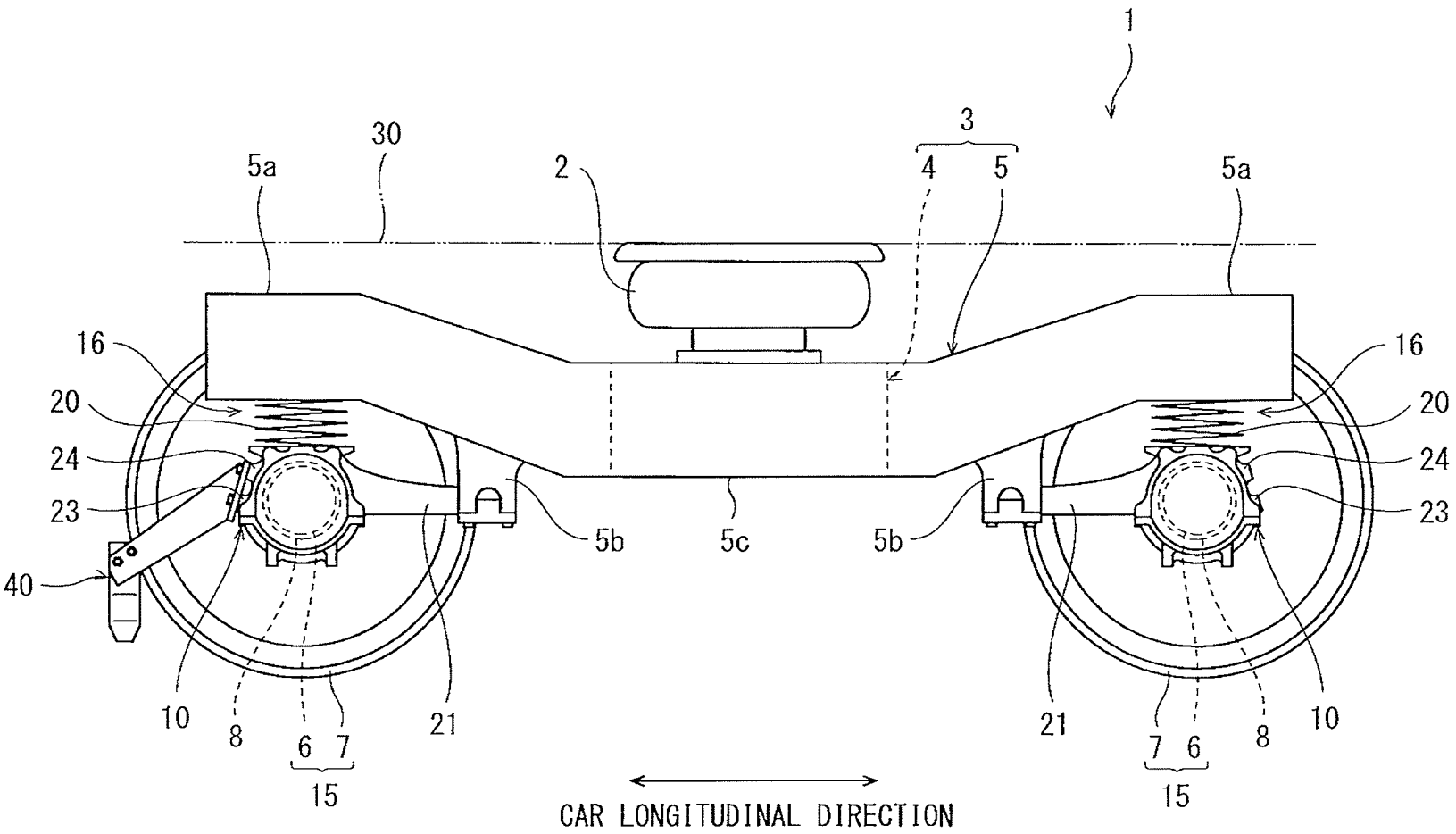
FIG. 1 is a side view of a railcar bogie according to Embodiment 1.

Hereinafter, embodiments will be explained with reference to the drawings. In the drawings, the same reference signs are used for the same or corresponding components, and a repetition of the same explanation is avoided.

Embodiment 1

FIG. 1 is a side view of a railcar bogie 1 according to Embodiment 1. As shown in FIG. 1, the railcar bogie (hereinafter referred to as a "bogie") 1 includes a bogie frame 3 configured to support a carbody 30 through an air spring 2. The bogie frame 3 includes: a cross beam 4 extending in a car width direction at a car longitudinal direction middle of the bogie 1; and side sills 5 extending in a car longitudinal direction from both respective car width direction end portions of the cross beam 4.

A pair of axles 6 each extending in the car width direction are arranged at both respective car longitudinal direction sides of the bogie frame 3. Wheels 7 are press-fitted to both respective car width direction sides of each of the axles 6. The axle 6 and the wheels 7 constitute a wheelset 15. A pair of wheelsets 15 provided at the bogie 1 are arranged at both respective car longitudinal direction sides of the bogie frame 3 so as to be spaced apart from each other. Bearings 8 rotatably supporting the wheels 7 are provided at both respective car width direction end portions of each axle 6 so as to be located outside the wheels 7 in the car width direction. The bearings 8 are accommodated in respective axle boxes 10.

Each of the axle boxes 10 is elastically coupled to the bogie frame 3 by a corresponding axle box suspension 16. The axle box suspension 16 includes an axle spring 20 and an axle beam 21. The axle spring 20 couples the axle box 10 and a car longitudinal direction end portion 5*a* of the side sill 5 in an upward/downward direction. The axle beam 21 couples the axle box 10 and a receiving seat 5*b* of the side sill 5 in the car longitudinal direction. The axle beam 21 is formed integrally with the axle box 10 and extends from the axle box 10 toward the cross beam 4 in the car longitudinal direction. A tip end portion of the axle beam 21 is elastically coupled to the receiving seat 5*b* of the side sill 5 through a rubber bushing and a core rod (not shown). The receiving seat 5*b* is provided so as to project downward from a part of a lower surface 5*c* of the side sill 5, the part being located between the axle box 10 and the cross beam 4 in the car longitudinal direction. An obstacle deflector 40 configured to eliminate obstacles on rails is attached to the axle box 10. In the present embodiment, the obstacle deflector 40 is attached to the axle box 10 located at a left side in FIG. 1. However, the obstacle deflector 40 may be attached to the axle box 10 located at a right side in FIG. 1.

Figure 2:
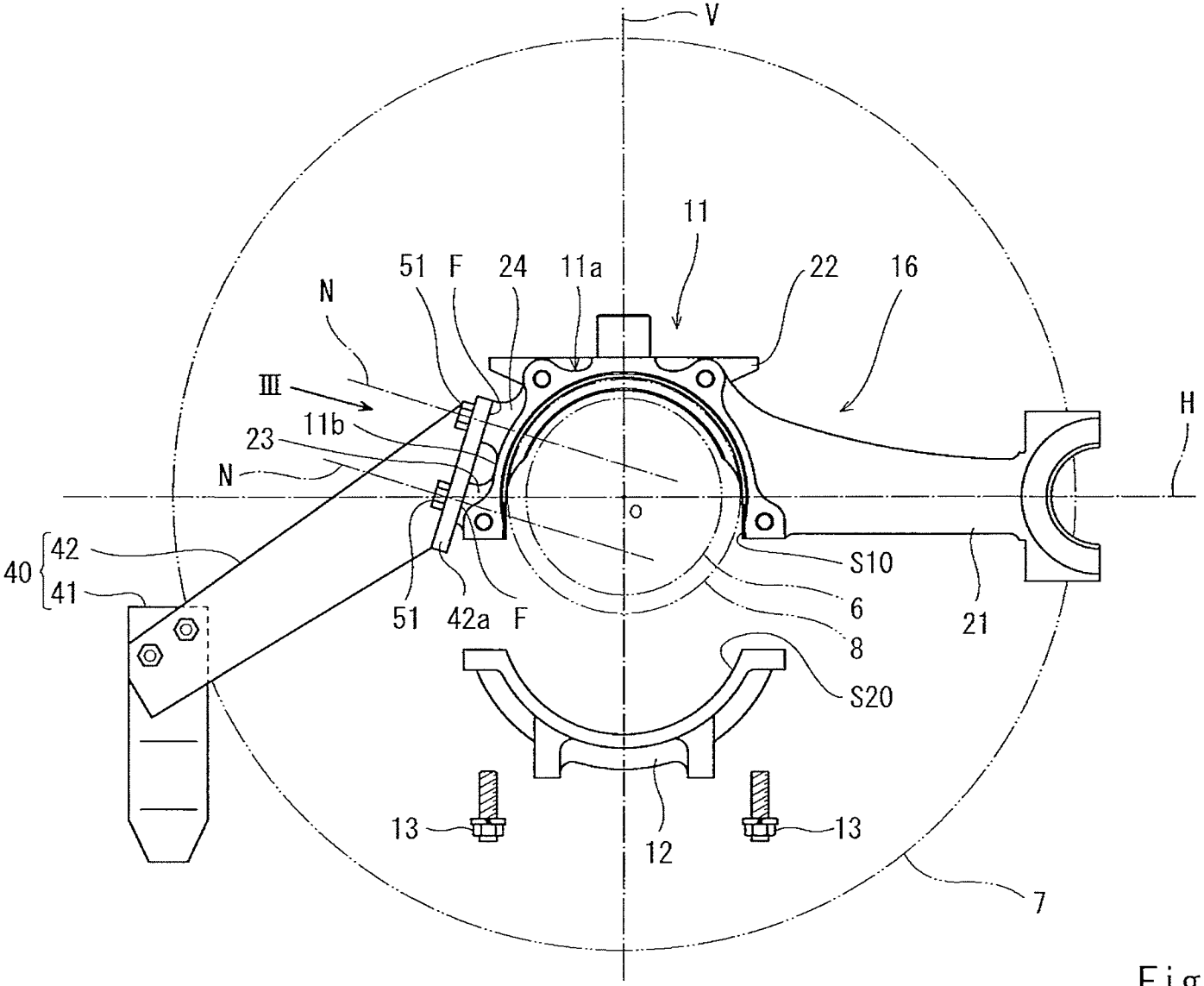
FIG. 2 is an exploded side view of an axle box to which an obstacle deflector shown in FIG. 1 is attached.

FIG. 2 is an exploded side view of the axle box 10 to which the obstacle deflector 40 shown in FIG. 1 is attached. As shown in FIG. 2, the axle box 10 is configured to be divided into upper and lower parts at a position lower than an axle center O. The axle box 10 includes an upper axle box element 11 and a lower axle box element 12. The upper axle box element 11 covers the bearing 8 from above. The lower axle box element 12 is attached to the upper axle box element 11 from below to cover the bearing 8 from below. The lower axle box element 12 is fixed to the upper axle box element 11 by fastening members 13, such as bolts. The upper axle box element 11 is formed integrally with the axle beam 21. The upper axle box element 11 covers the axle 6 of the wheelset 15, supported by the rails, from above through the bearing 8.

A space accommodating the bearing 8 is defined by an inner surface S10 of the upper axle box element 11 and an inner surface S20 of the lower axle box element 12. In a side view, each of the inner surface S10 of the upper axle box element 11 and the inner surface S20 of the lower axle box element 12 has a shape corresponding to a part of a perfect circle about the axle center O. An axle spring seat 22 supporting the axle spring 20 (see FIG. 1) from below is provided at an upper portion of the upper axle box element 11. In the present embodiment, the axle spring seat 22 is formed integrally with the upper axle box element 11, and an upper surface of the axle spring seat 22 constitutes an upper surface of the upper axle box element 11. It should be noted that the axle spring seat 22 may be formed separately from the upper axle box element 11.

A pair of receiving seats 23 and 24 to which the obstacle deflector 40 is fixed are provided at a car longitudinal direction outer side wall portion 11*b* of an outer peripheral wall portion 11*a* of the upper axle box element 11. In the side wall portion 11*b*, the receiving seat 23 is provided at a region intersecting with a horizontal line H extending in the car longitudinal direction through the axle center O, and the receiving seat 24 is provided slightly above the receiving seat 23. When viewed from the car width direction, the receiving seats 23 and 24 are inclined upward with respect to the horizontal line H. Further, the receiving seats 23 and 24 are formed integrally with the upper axle box element 11 and project from the side wall portion 11*b* of the upper axle box element 11 obliquely upward toward an outer side in the car longitudinal direction. The obstacle deflector 40 is fixed to the receiving seats 23 and 24 by fastening members 51, such as bolts.

Figure 3:
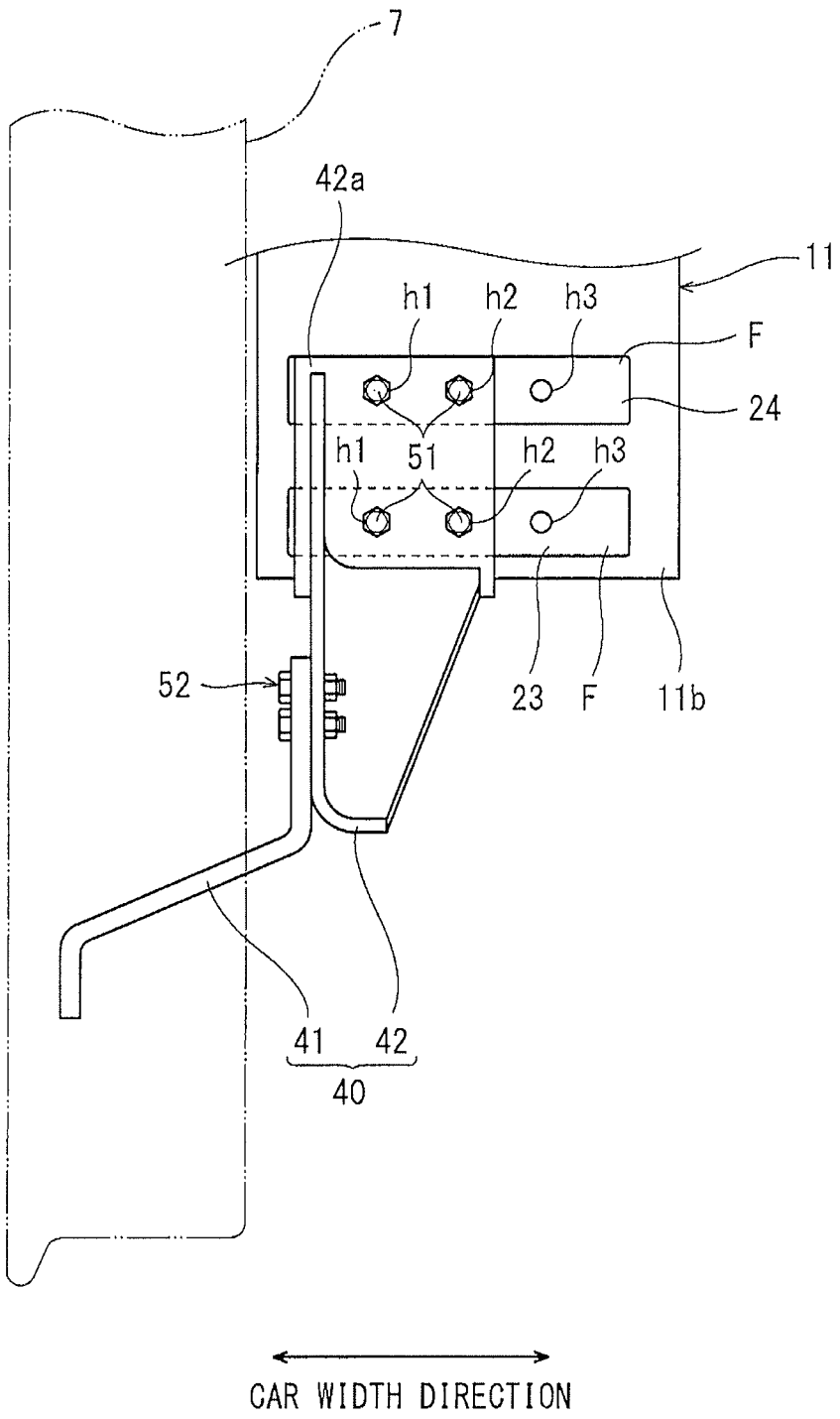
FIG. 3 is a diagram when viewed from an arrow III of FIG. 2.

FIG. 3 is a diagram when viewed from an arrow III of FIG. 2. As shown in FIGS. 2 and 3, the obstacle deflector 40 includes an obstacle deflecting portion 41 and a coupling portion 42. The obstacle deflecting portion 41 has a function of contacting obstacles on the rails to eliminate the obstacles toward an outer side of the rails. Therefore, the obstacle deflecting portion 41 is arranged at an outer side of the wheel 7 in the car longitudinal direction and partially overlaps the wheel 7 when viewed from the outer side in the car longitudinal direction. In a side view, the obstacle deflecting portion 41 is arranged lower than the upper axle box element 11. In the present embodiment, the obstacle deflecting portion 41 is formed by bending a metal plate (for example, a steel plate) but may be formed by rubber or a resin material.

The coupling portion 42 couples the obstacle deflecting portion 41 and the upper axle box element 11 in the car longitudinal direction. In a side view, the coupling portion 42 extends from a fixed portion thereof toward the receiving seats 23 and 24 so as to be inclined obliquely upward, the fixed portion being fixed to the obstacle deflecting portion 41. In the present embodiment, the coupling portion 42 is formed by a metal material as with the obstacle deflecting portion 41. It should be noted that the coupling portion 42 may be formed by a resin material. The coupling portion 42 is fixed to the obstacle deflecting portion 41 by fastening members 52 (for example, a bolt and a nut). The coupling portion 42 includes a plate-shaped fitting 42*a* fixed to the upper axle box element 11. The fitting 42*a* is fixed to the receiving seats 23 and 24 of the upper axle box element 11 by the plurality of bolts 51.

When viewed from the car longitudinal direction, each of the receiving seats 23 and 24 has a substantially rectangular shape that is long in the car width direction. Each of the receiving seats 23 and 24 is provided at the side wall portion 11*b* of the upper axle box element 11 such that in a side view, a normal line N of a fastening surface F intersects with a vertical line V passing through the axle center O (see FIG. 2). The fastening surfaces F of the receiving seats 23 and 24 are inclined obliquely downward toward the outer side in the car longitudinal direction. It should be noted that the fastening surfaces F of the receiving seats 23 and 24 are inclined surfaces but are not limited to these.

Three through holes h1 to h3 are provided on each of the fastening surfaces F of the receiving seats 23 and 24. The through holes h1 to h3 are subjected to tapping, and the bolts 51 are inserted into the through holes h1 to h3. Four through holes through which the bolts 51 penetrate are formed on the fitting 42*a* of the coupling portion 42. When fixing the coupling portion 42 of the obstacle deflector 40 to the receiving seats 23 and 24, the four through holes of the fitting 42*a* are arranged so as to overlap the through holes h1 and h2 of the receiving seats 23 and 24 in the car longitudinal direction, and the fitting 42*a* is then fixed by the bolts 51. With this, the obstacle deflector 40 can be attached to the receiving seats 23 and 24 so as to be located close to the wheel 7.

The bogie 1 configured as above has the following effects.

In the bogie 1, since the obstacle deflector 40 is fixed to the upper axle box element 11, it is unnecessary to interpose the lower axle box element 12. Therefore, even when vibrations are applied to the axle box 10 by traveling, force generated by the weight of the obstacle deflector 40 does not act on the lower axle box element 12. With this, unlike conventional cases, it is unnecessary to increase the strength of the lower axle box element 12, the strengths of the bolts 13 fastened to the upper axle box element 11, and the number of bolts 13. On this account, in the bogie 1, both the reduction of the influence of the obstacle deflector 40 and the relaxing of the requirement of the attaching strength of the obstacle deflector 40 can be realized.

The receiving seats 23 and 24 are inclined upward with respect to a horizontal surface. Therefore, even when an obstacle collides with the obstacle deflector 40, and a load in the car longitudinal direction acts on the obstacle deflecting portion 41, as force components acting on the receiving seats 23 and 24, a force component acting in a direction along the normal line N of the fastening surface F becomes large, and a force component acting in a direction parallel to the fastening surface F becomes small. Therefore, the requirement of the strength of the bolt 51 can be relaxed.

It should be noted that the receiving seats 23 and 24 may be provided vertical to the horizontal surface instead of being inclined upward with respect to the horizontal surface. Even in this case, the requirement of the strength of the attaching portion of the obstacle deflector can be relaxed while reducing the influence of the vibrations on the attaching portion.

Embodiment 2

A bogie 201 according to Embodiment 2 is obtained by partially changing, for example, the configuration of the bogie frame 3 of the bogie 1 according to Embodiment 1. Hereinafter, differences of the bogie 201 according to Embodiment 2 from the bogie 1 according to Embodiment 1 will be mainly explained.

Figure 4:
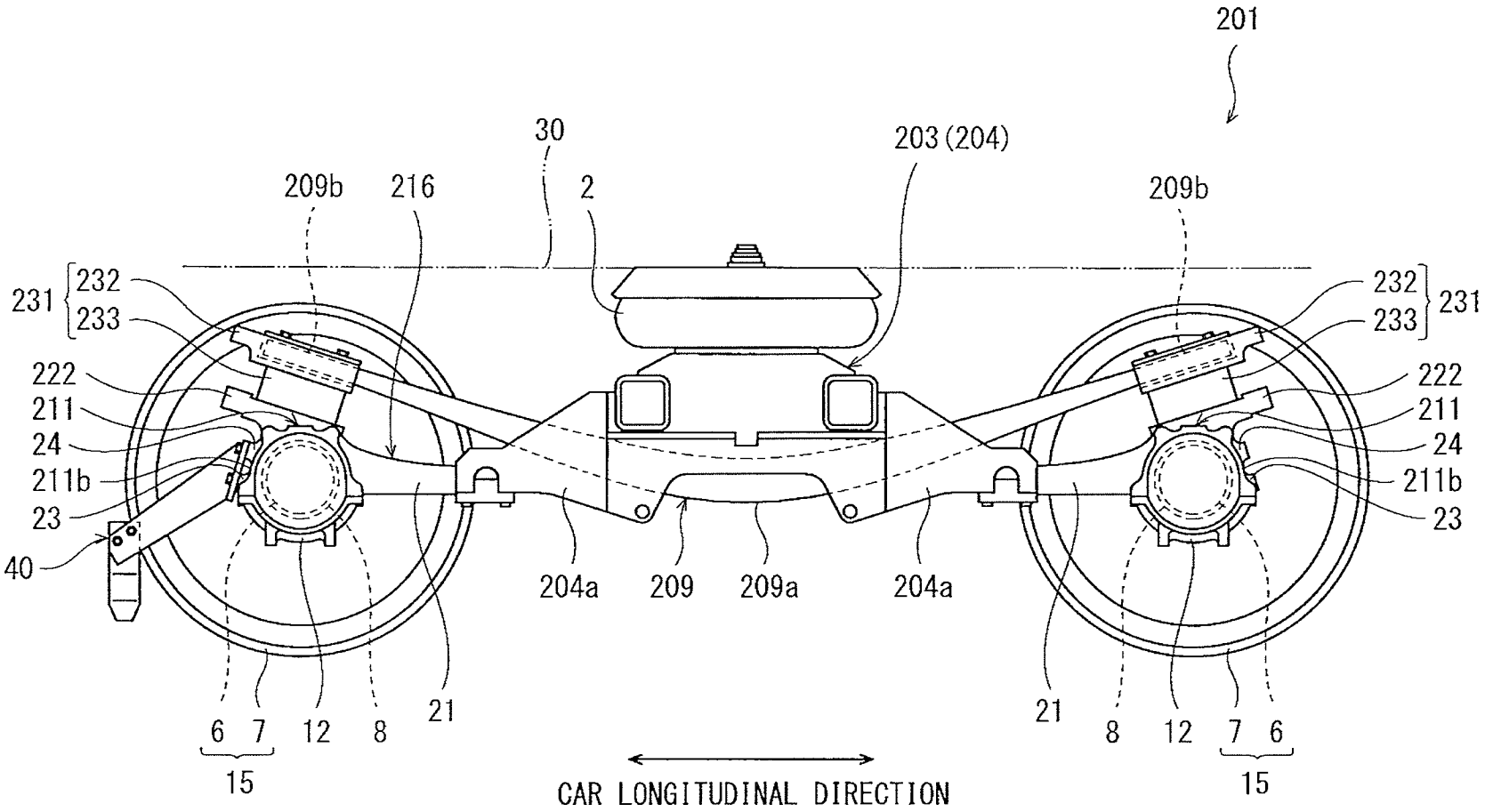
FIG. 4 is a side view of the railcar bogie according to Embodiment 2.

FIG. 4 is a side view of the bogie 201 according to Embodiment 2. As shown in FIG. 4, a bogie frame 203 includes a cross beam 204 extending in the car width direction at a car width direction middle of the bogie 201. However, unlike the configuration of the bogie frame 3 of Embodiment 1, the bogie frame 203 does not include the side sills 5.

Each of plate springs 209 extends between an axle box 210 and the cross beam 204 in the car longitudinal direction. Car longitudinal direction middle portions 209*a* of the plate springs 209 support both respective car width direction end portions 204*a* of the cross beam 204 from below, and both car longitudinal direction end portions 209*b* of each plate spring 209 are supported by the respective axle boxes 210. To be specific, the plate spring 209 has both the function of the axle spring 20 (primary suspension) of Embodiment 1 and the function of the side sill 5 of Embodiment 1.

The car longitudinal direction end portion 209*b* of the plate spring 209 is supported by the axle box 210 from below through a supporting member 231. The supporting member 231 is provided at an upper portion of the axle box 210. An upper surface of the supporting member 231 is inclined obliquely downward toward a middle side in the car longitudinal direction. It should be noted that the upper surface of the supporting member 231 does not have to be inclined as long as the upper surface of the supporting member 231 is substantially parallel to a lower surface of the car longitudinal direction end portion 209*b* of the plate spring 209. The supporting member 231 includes a receiving member 232 and a vibrationproof rubber 233. The receiving member 232 has a substantially rectangular shape in a plan view and includes: a bottom wall portion supporting the lower surface of the plate spring 209; and an outer wall portion projecting upward from both car longitudinal direction ends of the bottom wall portion.

The vibrationproof rubber 233 is substantially columnar and is inserted between the axle box 210 and the receiving member 232. A spring seat 222 is provided at an upper portion of an upper axle box element 211 of the axle box 210 and includes an upper surface which is in surface contact with a lower surface of the vibrationproof rubber 233. The upper surface of the spring seat 222 is also substantially parallel to the lower surface of the plate spring 209 and is inclined obliquely downward toward the middle side in the car longitudinal direction. The receiving seats 23 and 24 are provided at a car longitudinal direction outer side wall portion 211*b* of the upper axle box element 211 with which the spring seat 222 is formed integrally. Other than the above components, Embodiment 2 is the same as Embodiment 1.

Embodiment 2 can obtain the same effects as Embodiment 1. To be specific, the axle box 210 including the upper axle box element 211 at which the receiving seats 23 and 24 are provided is applicable to not only the bogie 1 including the typical bogie frame 3 but also the bogie 201 including the plate spring 209. With this, even when the obstacle deflector 40 is attached to the bogie 201 including the plate spring, both the suppression of the vibrations of the obstacle deflector 40 and the relaxing of the requirement of the attaching strength of the obstacle deflector 40 can be realized.

The present invention is not limited to the above embodiments, and modifications, additions, and eliminations may be made within the scope of the present invention. The above embodiments may be combined arbitrarily. For example, some of components or methods in one embodiment may be applied to another embodiment. In the above embodiment, the coupling portion 42 of the obstacle deflector 40 and the receiving seats 23 and 24 are fixed to each other by the four bolts 51. However, the above embodiment is not limited to this, and a fixing structure between the coupling portion 42 of the obstacle deflector 40 and the receiving seats 23 and 24 may be changed arbitrarily. In this case, the configurations and shapes of the receiving seats 23 and 24 may be changed in accordance with the fixing structure with the obstacle deflector 40.

REFERENCE SIGNS LIST

1, 201 railcar bogie
6 axle
7 wheel
8 bearing
10, 210 axle box
11, 211 upper axle box element
11*a* outer peripheral wall portion
12 lower axle box element
13 fastening member
15 wheelset
23, 24 receiving seat
40 obstacle deflector
41 obstacle deflecting portion
42 coupling portion
h1 to h3 through hole
F fastening surface
H horizontal line
P axis

The invention claimed is:

1. A railcar bogie comprising:

a wheelset including:

an axle extending in a car width direction, and a pair of wheels provided at both respective car width direction sides of the axle;

a bearing configured to rotatably support the wheelset;

an axle box including:

an upper axle box element covering the bearing from above the bearing, and a lower axle box element fixed to the upper axle box element by a fastening member and covering the bearing from below the bearing; and an obstacle deflector including:

an obstacle deflecting portion arranged at one side of the wheel in a car longitudinal direction and, when viewed from the one side in the car longitudinal direction, the obstacle deflecting portion overlaps at least one wheel, and a coupling portion configured to couple the obstacle deflecting portion to the axle box, the coupling portion of the obstacle deflector being fixed to only a receiving seat provided at the upper axle box element.

2. The railcar bogie according to claim 1, wherein the receiving seat is inclined upward with respect to a horizontal surface that the rail car bogie travels on.

3. The railcar bogie according to claim 1, wherein the receiving seat is provided vertically to a horizontal surface that the rail car bogie travels on.

4. A railcar bogie comprising:

a wheelset including:

an axle extending in a car width direction, and a pair of wheels provided at both respective car width direction sides of the axle;

a bearing configured to rotatably support the wheelset;

an axle box including:

an upper axle box element covering the bearing from above the bearing, and a lower axle box element fixed to the upper axle box element by a fastening member and covering the bearing from below the bearing; and an obstacle deflector including:

an obstacle deflecting portion arranged at one side of the wheel in a car longitudinal direction and, when viewed from the one side in the car longitudinal direction, the obstacle deflecting portion overlaps at least one wheel, and a coupling portion configured to couple the obstacle deflecting portion to the axle box, the coupling portion of the obstacle deflector being fixed to a receiving seat provided at the upper axle box element, wherein:

when viewed from the car width direction, the receiving seat is provided at a region of the upper axle box element, and the region is located at the one side of an axle center in the car longitudinal direction and intersecting with a horizontal line extending in the car longitudinal direction through the axle center.

5. A railcar bogie comprising:

a wheelset including:

an axle extending in a car width direction, and a pair of wheels provided at both respective car width direction sides of the axle;

a bearing configured to rotatably support the wheelset;

an axle box including:

an upper axle box element covering the bearing from above the bearing, and a lower axle box element fixed to the upper axle box element by a fastening member and covering the bearing from below the bearing;

an obstacle deflector including:

an obstacle deflecting portion arranged at one side of the wheel in a car longitudinal direction and, when viewed from the one side in the car longitudinal direction, the obstacle deflecting portion overlaps at least one wheel, and a coupling portion configured to couple the obstacle deflecting portion to the axle box, the coupling portion of the obstacle deflector being fixed to a receiving seat provided at the upper axle box element; and a fastening member fixing the receiving seat and the coupling portion to each other, wherein:

the receiving seat is provided with a fastening surface including a through hole into which the fastening member is inserted; and the receiving seat is provided at an outer peripheral wall portion of the upper axle box element such that, in a side view, a normal line of the fastening surface intersects with a vertical line passing through the axle center.

* * * * *